US007614710B2

(12) United States Patent
Haines et al.

(10) Patent No.: US 7,614,710 B2
(45) Date of Patent: Nov. 10, 2009

(54) VENT SEAL

(75) Inventors: Paul Mark Haines, Lebanon, OR (US); Joseph E Scheffelin, Poway, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 738 days.

(21) Appl. No.: 10/976,633

(22) Filed: Oct. 29, 2004

(65) Prior Publication Data

US 2006/0092242 A1 May 4, 2006

(51) Int. Cl.
*B41J 2/195* (2006.01)
*B41J 29/38* (2006.01)
*B41J 2/19* (2006.01)

(52) U.S. Cl. ..... 347/7; 347/6; 347/92

(58) Field of Classification Search ..... 347/84–87, 347/6, 7, 92
See application file for complete search history.

(56) References Cited

U.S. PATENT DOCUMENTS 4,771,295 A * 9/1988 Baker et al. ..... 347/87
4,924,860 A * 5/1990 Larsen et al. ..... 128/205.12
5,047,790 A * 9/1991 Cowger et al. ..... 347/87
5,364,595 A * 11/1994 Smith ..... 422/100
5,526,030 A * 6/1996 Baldwin et al. ..... 347/87
5,801,737 A * 9/1998 Sato et al. ..... 347/86
5,949,461 A * 9/1999 Jones et al. ..... 347/87
6,145,974 A * 11/2000 Shinada et al. ..... 347/87
6,149,266 A 11/2000 Cook
6,206,513 B1 * 3/2001 Tajima et al. ..... 347/86
6,258,276 B1 * 7/2001 Mika et al. ..... 210/638
6,276,785 B1 * 8/2001 Shinada et al. ..... 347/86
6,280,024 B1 * 8/2001 Miyazawa et al. ..... 347/86
6,299,296 B2 10/2001 Gasvoda
6,453,955 B1 * 9/2002 Lee ..... 141/198
6,460,982 B1 10/2002 Ito
6,474,798 B1 * 11/2002 Shinada et al. ..... 347/86
6,474,802 B1 11/2002 Lui
6,733,114 B2 * 5/2004 Kobayashi et al. ..... 347/85
6,905,198 B2 * 6/2005 Studer et al. ..... 347/86
6,962,408 B2 * 11/2005 Steinmetz et al. ..... 347/85
7,040,743 B2 * 5/2006 Acosta et al. ..... 347/86
7,188,942 B2 * 3/2007 Haines et al. ..... 347/93
2002/0063759 A1 * 5/2002 Hirano et al. ..... 347/85
2002/0179527 A1 * 12/2002 Yao ..... 210/634
2003/0020794 A1 1/2003 Chou
2003/0048338 A1 3/2003 Qingguo
2003/0128257 A1 7/2003 Qingguo
2003/0142180 A1 * 7/2003 Gonzales ..... 347/86
2004/0052689 A1 3/2004 Yao
2004/0183870 A1 * 9/2004 Steinmetz et al. ..... 347/85
2005/0121075 A1 * 6/2005 Riviezzo ..... 137/202
2006/0070656 A1 * 4/2006 Crawford ..... 137/202
2006/0071989 A1 * 4/2006 Lewey et al. ..... 347/86

FOREIGN PATENT DOCUMENTS

JP 6031931 8/1994

* cited by examiner

*Primary Examiner*—Stephen D Meier
*Assistant Examiner*—Rene Garcia, Jr.

(57) ABSTRACT

One embodiment of a vent seal includes a vent that defines a vent channel and a seal positioned within the channel in both a closed vent condition and in an open vent condition.

31 Claims, 1 Drawing Sheet

VENT SEAL

BACKGROUND

Printing mechanisms may include a printhead for printing an image on a media. Ink may be supplied to the printhead by an ink supply container. The ink supply container may be filled prior to initial use of the printing mechanism. A vent may be positioned in the ink supply container so as to allow the escape of gas during filling of the ink reservoir with fluid.

DETAILED DESCRIPTION OF THE DRAWINGS

Figure 1:
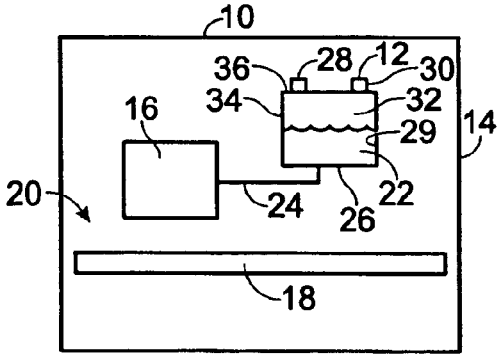
FIG. 1 is a schematic view of one embodiment of a printing mechanism that may include one embodiment of a vent seal.

FIG. 1 is a schematic view of one embodiment of a printing mechanism 10 that may include one embodiment of a vent seal 12. Printing mechanism 10 may comprise any mechanism that may be adapted for forming an image on a media, for example, printing an ink image on a sheet of paper. Printing mechanism 10 may include a housing 14 that may include therein a print cartridge 16 adapted for printing an image on a media 18 that may be moved along a media path 20 within housing 14. Print cartridge 16 may be supplied with fluid, such as ink 22, via a conduit 24 from a fluid supply container such as an ink supply container 26. Ink supply container 26 may be positioned separate from print cartridge 16 as shown, or in another embodiment may be positioned integral with print cartridge 16. The embodiment shown, wherein ink container 26 may be positioned separate from print cartridge 16, may be referred to as an off-axis ink supply whereas an embodiment wherein the ink container may be positioned integral with a print cartridge may be referred to as an on-axis ink supply. Ink supply container 26 may also comprise a component of print cartridge 16.

Ink supply container 26 may include a fill port 28 for filling an interior 29 of ink container 26 with fluid, such as with ink 22. However, the vent ports may be recessed within an outer surface of container 26. Container 26 may also include a vent port 30 which may allow gas, such as air 32, to vent from container 26 as ink 22 flows into the container through fill port 28 and displaces the air. Vent port 30 may be positioned in an upper region 34 of container 26 during filling of container 26, such as on a top surface 36 of container 26. Positioning of vent port 30 in upper region 34 of container 26 during filling may allow container 26 to be completely filled with ink 22 before ink may begin to flow through vent port 30 such that air is not trapped within container 26. After container 26 is filled with ink the container may be orientated in a different orientation such that region 34 may not be the upper region of container 26 during other times, such as during printing. For ease of illustration in FIG. 1, fill port 28 and vent port 30 are both shown extending upwardly from top surface 36 of container 26.

Figure 2:
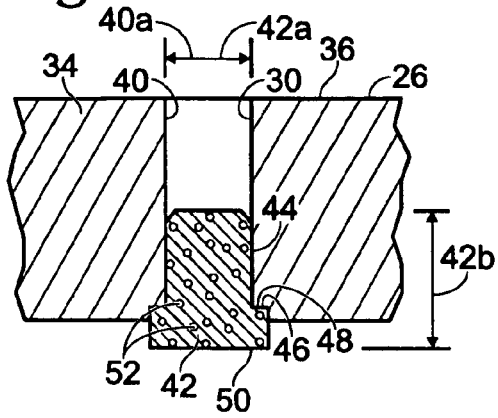
FIG. 2 is a partial cross-sectional side view of one embodiment of an ink supply including one embodiment of a vent seal.

FIG. 2 is a partial cross-sectional side view of one embodiment of ink supply container 26 including one embodiment of vent seal 12. Vent port 30 may define a channel 40, which may also be referred to as a vent aperture or a vent opening, wherein air 32 within container 26 may flow through channel 40 as container 26 is filled with ink 22. Vent seal 12 may comprise a plug 42 that may be frictionally secured within channel 40. In the embodiment shown, plug 42 may comprise a cylinder 44 having an outwardly extending shoulder 46 that may extend circumferentially around plug 42. Channel 40 may comprise a cylinder having an inwardly extending contact surface 48 that may act as a stop surface when plug 42 is inserted into channel 40. Accordingly, during assembly, plug 42 may simply be press fit into channel 40 until shoulder 46 contacts surface 48.

Still referring to FIG. 2, plug 42 may be manufactured of a porous material 50, such as an open cell foam. Plug 42 may further include a clogging agent 52 impregnated within or dispersed throughout porous material 50. Clogging agent 52 may comprise a material that may remain in a deactivated state during the passage of gas, such as air 32, through plug 42. However, upon contact of a fluid, such as ink 22, with clogging agent 52, the clogging agent may become activated so as to expand within porous material 50 so as to define a fluid impervious barrier within channel 40. Clogging agent 52 may be very fast acting such that plug 42 may prevent the escape of any fluid from container 26. In other words, upon contact of a fluid with plug 42, plug 42 and clogging agent 52 therein may be activated from a flow-through condition to a non-flow condition, thereby defining a fluid impervious barrier within vent port 30. Positioning of plug 42 within top surface 36 of container 26 may allow complete or near complete filling of container 26 with ink 22 such that little air 22 may be trapped within container 26. Such a complete or a near complete filling of container 26 with ink 22 may be referred to a full container 26. In other words, a full container 26 is defined as meaning that a fluid, such as ink 22, is filled within container 26 to a positioned adjacent top surface 36 of the container.

Porous material 50 may be manufactured of a variety of materials. Depending upon the particular application for which the porous material is to be used, the porous material may comprise any material that is not soluble in water including, but not limited to: metals, metal oxides, and alloys; ceramics; inorganic and organic materials such as graphite, glass, paper, and organic polymers; and mixtures thereof. In some embodiments, the porous material may be an organic polymer. Examples of specific organic polymers may include, but are not limited to: acrylic polymers; polyolefins such as, but not limited to, polyethylene and polypropylene; polyesters; polyamides such as nylon; poly(ether sulfone); polytetrafluoroethylene; polyvinyl chloride; polycarbonates; and polyurethanes.

Clogging agent 52 may be manufactured of a variety of materials. In one embodiment the clogging agent material may comprise a hydrogel adhered to the pore walls of a porous material, discussed above. The hydrogel may be a polymer selected from the group consisting of hydrophilic polyurethane, hydrophilic polyurea, and hydrophilic polyureaurethane. In one embodiment the hydrogel may be hydrophilic polyurethane. In another embodiment, clogging agent 52 may be a hydrophilic polyurethane made from the reaction of a polyol and a diisocyanate in a molar ratio of from about 80:100 to about 20:100, more particularly from about 70:100 to about 40:100, and even more particularly from about 65:100 to about 50:100.

In the embodiment shown, channel 40 may have a diameter 40*a* of approximately ⅛ inch. Plug 42 may have a diameter 42*a* of approximately ⅛ inch and a length 42*b* of approximately ¼ inch. Other sizes and shapes of the seal and the channel may be utilized in other embodiments.

Figure 3:
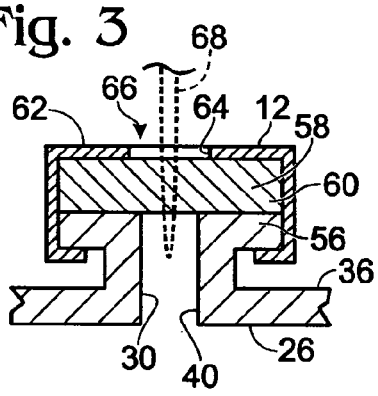
FIG. 3 is a partial cross-sectional side view of one embodiment of an ink supply including one embodiment of a vent seal.

FIG. 3 is a partial cross-sectional side view of one embodiment of an ink supply container 26 including one embodiment of a vent seal 12. In this embodiment, vent port 30 may include an upwardly extending shoulder or flange 56. Vent seal 12 may comprise a septum 58, such as a membrane 60 positioned on flange 56 and extending over channel 40. Membrane 60 may be secured in place by a crimp cap 62 that may extend around an underside of flange 56. Crimp cap 62 may include a central aperture 64 therein that may allow access to membrane 60 in a central region 66 of crimp cap 62. Membrane 60 may be manufactured of a flexible, elastic material such as rubber. In this embodiment vent seal 12 may allow the passage of air 22 therethrough when a venting structure, such as a needle 68 (shown in dash lines) is inserted through membrane 60. When container 26 is filled with ink, needle 68 may be removed. Upon removal of needle 68, membrane 60 may seal the hole through which needle 68 extended, so as to define a fluid-tight seal on vent port 30. Accordingly, in this embodiment, vent seal 12 may be referred to as self-sealing in that once needle 68 is removed, no further action by an operator is required to seal vent seal 12.

Figure 4A:
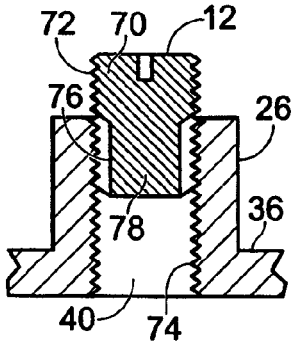
FIGS. 4A and 4B are partial cross-sectional side views of one embodiment of an ink supply including one embodiment of a vent seal, in an open and a closed position, respectively.
Figure 4B:
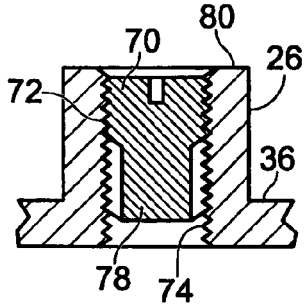

FIGS. 4A and 4B are partial cross-sectional side views of one embodiment of ink supply container 26 including one embodiment of vent seal 12, in an open and a closed position, respectively. In this embodiment vent seal 12 may comprise an adjustable screw, such as set screw 70. Screw 70 may include threads 72 that may mate with threads 74 in channel 40 so as to releasably secure screw 70 therein. Screw 70 may further include grooves 76 that may extend along a lower portion 78 of screw 70 such that gas or fluid may vent through channel 40 when screw 70 is in a raised or an open condition, shown in FIG. 4A. When screw 70 is tightened or lowered within channel 40, grooves 76 may not access an exterior 80 of container 26 such that screw 70 may define a gas and fluid-tight seal within aperture 40. In this embodiment, screw 70 may be manually tightened after container 26 is filled with ink.

Figure 5:
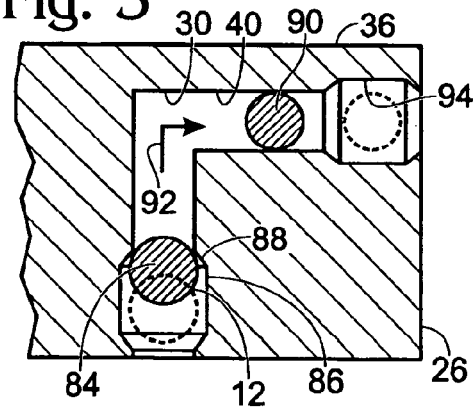
FIG. 5 is a partial cross-sectional side view of one embodiment of an ink supply including one embodiment of a vent seal.

FIG. 5 is a partial cross-sectional side view of one embodiment of ink supply container 26 including one embodiment of vent seal 12. In this embodiment vent seal 12 may comprise a float 84 manufactured of a material heavier than air and lighter than a fluid, such as ink. Float 84 may be positioned within an expanded diameter region 86 of channel 40 such that float 84 is retained therein. During filling of container 26 with ink, air may pass around float 84 through expended diameter region 86 and out of vent port 30. After container 26 is filled with ink, the ink may contact float 84 thereby raising the float within expanded region 86 such that float 84 blocks an upper region 88 of region 86 thereby defining a fluid-tight seal within channel 40. Accordingly, in this embodiment, vent seal 12 may be referred to as self-sealing in that no action by an operator is required to seat vent seal 12 within channel 40.

Still referring to FIG. 5, channel 40 may further include a second seal 90 positioned in a downstream direction 92 from first seal 12. In this embodiment, second seal 90 may comprise a ball that may be retained within a second expanded diameter region 94 of channel 40 during venting of air through channel 40. After filling of container 26 with ink such that first seal 12 is moved from the venting or open position (shown in dash lines) to the sealed or closed position (shown in solid line), second seal 90 may be press fit into channel 40 from an open position (shown in dash lines) to a closed position (shown in solid line) by an operator so as to define a permanent seal of channel 40. In this manner, first seal 12 may act as a temporary seal that is actuated when container 26 is filled with ink. Once first seal 12 is actuated, an operator may secure a permanent, second seal 90 in place. Press fit may be defined as pressing ball seal 90 into channel 40, wherein an inner diameter of channel 40 may be approximately the same size as an outer diameter of ball seal 90. Accordingly, seal 90 may be frictionally retainer within channel 40 while defining a fluid impervious barrier within the channel.

In other embodiments, other combinations of seals may be utilized. For example, in one embodiment porous plug 42 of FIG. 1 may be used as a first seal and set screw 70 of FIG. 4 may be used as a second, permanent seal, positioned downstream from plug 42. Products having a short use life may only have a single seal, such as porous plug 42, positioned therein. Products having a longer use life may have a double or a back-up seal arrangement, as shown in FIG. 5.

Figure 6:
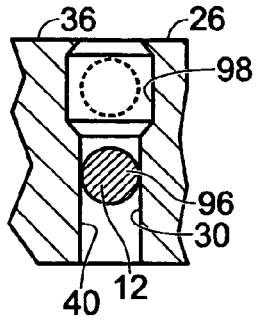
FIG. 6 is a partial cross-sectional side view of one embodiment of an ink supply including one embodiment of a vent seal.

FIG. 6 is a partial cross-sectional side view of one embodiment of ink supply container 26 including one embodiment of vent seal 12. In this embodiment, vent seal 12 may comprise a ball 96 that may be retained within an expanded diameter region 98 of channel 40 during venting of air through channel 40. After filling of container 26 with ink, ball 90 may be press fit into channel 40 from an open or venting position in expanded diameter region 98 (shown in dash lines) to a closed position (shown in solid line) by an operator so as to define a permanent seal of channel 40.

Other variations and modifications of the concepts described herein may be utilized and fall within the scope of the claims below.

We claim:

1. An ink supply container, comprising:

a body including an interior adapted for containing ink therein;

a vent port for venting gas from said interior; and a sealing structure stationarily positioned within said vent port, said stationary sealing structure manufactured of a first material and having a clogging agent positioned there throughout, said sealing structure allowing gas to vent through said vent port and inhibiting ink from venting through said vent port at an ambient pressure.

2. A container according to claim 1 wherein said sealing structure is chosen from the group including a porous plug, a septum, a screw, a float and a press-fit ball.

3. A container according to claim 1 wherein said sealing structure comprises a porous plug including said clogging agent therein, said clogging agent activated by contact with ink.

4. A container according to claim 3 wherein said porous plug is manufactured of a material chosen from the group including polyethylene, a fluoropolymer resin and polypropylene.

5. A container according to claim 3 wherein said clogging agent is manufactured of a hydrogel.

6. A container according to claim 3 wherein said porous plug includes an outwardly extending shoulder, said vent port includes an inwardly extending shoulder, and wherein said outwardly extending shoulder of said porous plug mates with said inwardly extending shoulder of said vent port so as to position said porous plug within said vent port.

7. A container according to claim 1 further including a fill port adapted for filling said interior with ink.

8. A container according to claim 1 wherein said vent port is positioned in an upper region of said interior when said interior is filled with ink.

9. A container according to claim 1 further comprising a second seal positioned within said vent port downstream of said sealing structure.

10. A container according to claim 1 wherein said body comprises an off-axis inkjet ink reservoir.

11. A vent port seal, comprising:

a vent that defines a vent channel in an ink supply container; and a seal stationarily positioned within said vent channel such that said stationary seal is positioned in a stationary single location in both a closed vent condition and in an open vent condition, said seal manufactured of a first material and having a clogging agent positioned there throughout, said seal allowing gas to vent through said vent and inhibiting ink from venting through said vent at an ambient pressure.

12. A seal according to claim 11 wherein said seal comprises a foam material impregnated with said clogging agent, wherein said clogging agent is activated by contact with a fluid, and wherein said foam material and said clogging agent allow gas to pass therethrough prior to activation of said clogging agent.

13. A seal according to claim 11 wherein said seal comprises a foam material impregnated with said clogging agent, wherein said clogging agent is activated by contact with a fluid, and wherein said foam material and said clogging agent inhibit gas from passing therethrough after activation of said clogging agent.

14. A seal according to claim 11 wherein said vent channel is positioned in an upper position of an ink supply container during filling of said container with an ink.

15. A seal according to claim 11 wherein said seal comprises one of a ball, a septum, a float and a screw.

16. A method of sealing an ink supply vent port, comprising:

supplying a first volume of ink to an ink supply wherein gas is vented from said ink supply through a self-sealing seal in a vent port during said supplying said first volume, and supplying a second volume of ink to an ink supply such that ink contacts said self-sealing seal, wherein contact of ink with said self-sealing seal seals said vent port against ink flowing therethrough;

wherein said self-sealing seal comprises a first material having a clogging agent impregnated therein, said clogging agent activated from an open condition to a blocked condition upon contact of ink with said seal in an absence of suction pressure.

17. A method according to claim 16 wherein said vent port is positioned in said ink supply such that ink contacts said seal only when said ink supply is full of ink.

18. A method according to claim 16 wherein said supplying said first and second volumes is conducted through a fill port of said ink supply.

19. A method according to claim 16 further comprising placing a second seal in said vent port downstream of said seal.

20. A method according to claim 19 wherein said placing said second seal is chosen from one of tightening a threaded seal and press-fitting a ball seal.

21. An ink container, comprising:

a vent aperture positioned within a wall of said ink container; and a fluid-activated seal positioned within said vent aperture, said fluid-activated seal allowing gas to vent therethrough and inhibiting fluid from flowing therethrough, said fluid-activated seal manufactured of a first material and having a clogging agent positioned on said first material, said fluid-activated seal allowing gas to vent through said vent aperture and inhibiting ink from venting through said vent aperture at an ambient pressure.

22. An ink container according to claim 21 wherein said clogging agent is activated by contact with a fluid.

23. An ink container according to claim 22 wherein said clogging agent is a hydrogel.

24. An ink container according to claim 21 wherein said seal comprises a porous material chosen from one of a metal, a metal oxide, a metal alloy, ceramic, graphite, glass, paper, an organic polymer, and mixtures thereof.

25. An ink container according to claim 21 wherein said vent aperture is positioned so that fluid contacts said seal only when said ink container is full of fluid.

26. An ink container, comprising:

means for venting gas therefrom; and means for sealing said means for venting, said means for sealing changing from an open condition to a closed condition upon contact of an ink with said means for sealing, said means for sealing manufactured of a first material and having a self-sealing agent positioned there throughout, said means for sealing allowing gas to vent through said means for venting and inhibiting ink from venting through said means for venting at an ambient pressure.

27. An ink container according to claim 26 wherein said means for sealing in said open condition allows gas to vent therethrough and said means for sealing in said closed condition inhibits ink from flowing therethrough.

28. An ink container according to claim 26 wherein said self-sealing agent is activated from a flow-through condition to a non-flow condition by contact with an ink.

29. An ink container according to claim 26 wherein said means for sealing comprises a float.

30. An ink container according to claim 26 wherein said means for venting extends through a top surface of said ink container.

31. An ink container according to claim 26 wherein said first material comprises a porous material chosen from one of a metal, a metal oxide, a metal alloy, ceramic, graphite, glass, paper, an organic polymer, and mixtures thereof.

* * * * *